US005626464A

United States Patent [19]

Schoenmeyr et al.

[11] Patent Number: 5,626,464

[45] Date of Patent: May 6, 1997

[54] WOBBLE PLATE PUMP

[75] Inventors: Ivar L. Schoenmeyr, San Juan Capistrano; Dave M. Slagle, Escondido, both of Calif.

[73] Assignee: Aquatec Water Systems, Inc., Anaheim, Calif.

[21] Appl. No.: 447,994

[22] Filed: May 23, 1995

[51] Int. Cl.[6] ..... F04B 1/12

[52] U.S. Cl. ..... 417/269; 92/98 R; 92/100

[58] Field of Search ..... 417/269; 92/13, 92/98 D, 98 R, 100

[56] References Cited

U.S. PATENT DOCUMENTS

| | | | |
|---|---|---|---|
| 3,077,118 | 2/1963 | Robbins | 417/269 |
| 4,153,391 | 5/1979 | Hartley | 417/269 |
| 4,396,357 | 8/1983 | Hartley | 417/269 |
| 4,515,531 | 5/1985 | Roser | 417/269 |
| 4,610,605 | 9/1986 | Hartley | 417/269 |

*Primary Examiner*—Charles G. Freay
*Attorney, Agent, or Firm*—Blakely Sokoloff Taylor & Zafman

[57] ABSTRACT

The present invention is a wobble plate pump typically used in a reverse osmosis water purification system. The pump has a piston that is coupled to a wobble plate by a rocker arm. The piston has a stem which snaps into a corresponding sleeve of a diaphragm. The diaphragm is attached to the rocker arm and extends across the inner diameter of the pump to provide an inner pump seal. The piston stem and diaphragm sleeve extend through an access opening in a diaphragm support plate. The access opening of the wobble plate has an inner lip defined by a first relatively small radius near the center of the pump and a second relatively larger radius at the outer portion of the pump. The dual radiuses allow the piston to symmetrically reciprocate about a surface of the diaphragm support plate without inducing excessive stresses in the diaphragm. The symmetrical reciprocating motion maximizes the compression ratio of the pump. The manifold plate has outlet passages located in a top portion of the chamber, so that when the pump is mounted in a horizontal position any air collected in the top portion of the chamber will be pushed through the passages. The manifold plate also has an air bleed passage that allows entrapped air to escape the pump chamber when the pump is mounted in a vertical, motor up, position.

31 Claims, 8 Drawing Sheets

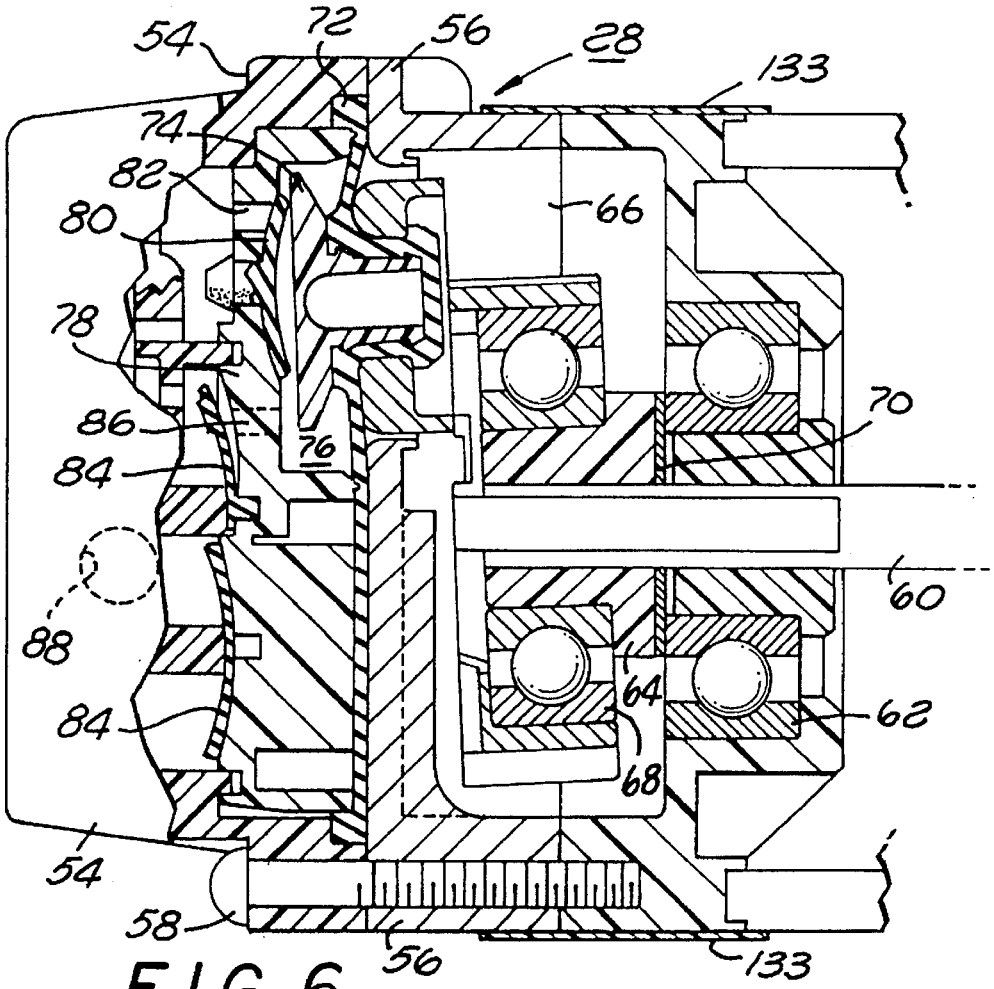
FIG. 6
FIG. 7
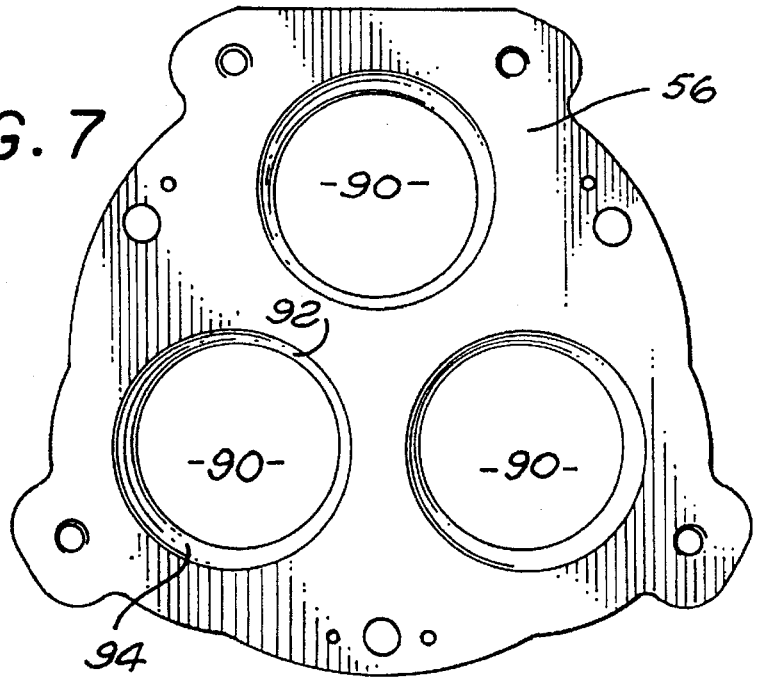

WOBBLE PLATE PUMP

BACKGROUND OF THE INVENTION

1. Field of the Invention

The present invention relates to a wobble plate pump.

2. Description of Related Art

Impurities are sometimes removed from water by a reverse osmosis (RO) water purification system. By way of example, a RO unit can be attached to the municipal water supply of a kitchen. The municipal water passes through a reverse osmosis membrane which removes impurities from the water. The pressure drop across the reverse osmosis membrane is relatively high. In some locations the pressure of the municipal water is not great enough to push the water through the RO membrane. For this reason RO units typically have a pump that increases the pressure of the water provided to the reverse osmosis membrane.

FIG. 1 shows a wobble plate pump disclosed in U.S. Pat. No. 4,610,605 issued to Hartley. The Hartley pump has three pistons 1 (only one is shown) that are reciprocated by a wobble plate 2. The wobble plate 2 is typically rotated by the drive shaft 3 of an electric motor (not shown). The piston 1 is attached to a diaphragm 4 which provides an internal seal for the pump.

The piston 1 reciprocates within a pump chamber 5 that is defined by a manifold plate 6. The plate 6 has a one-way inlet valve 7 that allows water to flow into the pump chamber 5 and a one-way outlet valve 8 that allows water to flow out of the pump chamber 5.

The pistons 1 are located symmetrically about the motor drive shaft 3 and swing about a radial arc relative to the drive shaft centerline. The swinging motion of the pistons cause the outer portion of the diaphragm 4 to move a greater distance than the inner portion of the diaphragm 4. The outer portion of the diaphragm will therefore deflect more than the inner diaphragm portion. The unequal diaphragm deflection induces stress in the diaphragm material and decreases the life of the pump. Hartley reduced the diaphragm stress by providing excess material in the outer portions of the diaphragm. It has been found that the excess material can become pinched between the piston and the adjacent housing support element. Diaphragm pinching can be avoided by limiting the travel of the piston. Restricting the travel of the piston reduces the compression ratio of the pump cycle and lowers the output of the pump. It would be desirable to provide a wobble plate pump that minimizes the stresses on the pump diaphragm and maximizes the compression ratio of the pump.

The pistons 1 are attached to a rocker arm 9 by a plurality of screws 10. Having to install screws increases the assembly time and overall cost of producing the pump. Additionally, it has been found that water may leak past the piston/rocker arm interface 11 and into the wobble plate 2. If the electric motor is mounted below the pump, the water may leak into the motor and damage the same. It would be desirable to provide a piston/diaphragm/rocker arm assembly that was relatively inexpensive to assemble and totally seals the wobble plate area of the pump.

As shown in FIG. 2, the pump assembly may be mounted in a vertical position so that the electric motor is located above the pump chamber. Any air that becomes entrapped within the pump chamber 5 will collect in the top of the chamber adjacent to the piston 1. Because the outlet valve 8 is located in the bottom of the pump chamber 5, the air will typically remain in the chamber even during the power stroke of the piston 1. Likewise, when the pump is mounted in a horizontal position, the air will become entrapped in the top of the pump chambers. The entrapped air will cavitate and reduce the output of the pump. It would be desirable to provide a wobble plate pump which evacuates air from the pump chambers when the pump is mounted in either a horizontal portion, or a vertical (motor up) position.

The motor and pump are typically mounted to a wall or base surface by a mounting bracket. AC Power is provided to the motor at a frequency of approximately 50–60 hertz (Hz). This frequency of power can create a resonance in the motor that produces a "humming" sound which reverberates through the mounting bracket and into the wall. The hum can be annoying to the end user. Rubber feet can be placed between the wall and the mounting bracket to dampen the humming sound of the assembly. The rubber feet have been found to dampen only resonant frequencies much lower than 50–60 Hz and are thus ineffective in eliminating the hum of the pump. It would be desirable to provide a mounting bracket that can dampen the resonant audible frequency created by the electric motor.

SUMMARY OF THE INVENTION

The present invention is a wobble plate pump typically used in a reverse osmosis water purification system. The pump has a piston that is coupled to a wobble plate by a rocker arm. The piston has a stem which snaps into a corresponding sleeve of a diaphragm. The diaphragm is attached to the rocker arm and extends across the inner diameter of the pump to provide an inner pump seal. The piston stem and diaphragm sleeve extend through an access opening in a diaphragm support plate. The access opening of the wobble plate has an inner lip defined by a first relatively small radius near the center of the pump and a second relatively larger radius at the outer portion of the pump. The dual radiuses allow the piston to symmetrically reciprocate about a surface of the diaphragm support plate without inducing excessive stresses in the diaphragm. The symmetrical reciprocating motion maximizes the compression ratio of the pump. The piston reciprocates within a pump chamber defined by a manifold plate. The manifold plate has outlet passages located in a top portion of the chamber, so that when the pump is mounted in a horizontal position any air collected in the top portion of the chamber will be pushed through the passages. The manifold plate also has an air bleed passage that allows entrapped air to escape the pump chamber when the pump is mounted in a vertical, motor up, position. The assembly has a mounting bracket which dampens the resonant audible frequency created by the pump motor and a desiccant that is located with a breather port of the motor.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 6 is a cross-sectional view of the pump;

FIG. 7 is a top view of a diaphragm support plate;

DETAILED DESCRIPTION OF THE INVENTION

Figure 1:
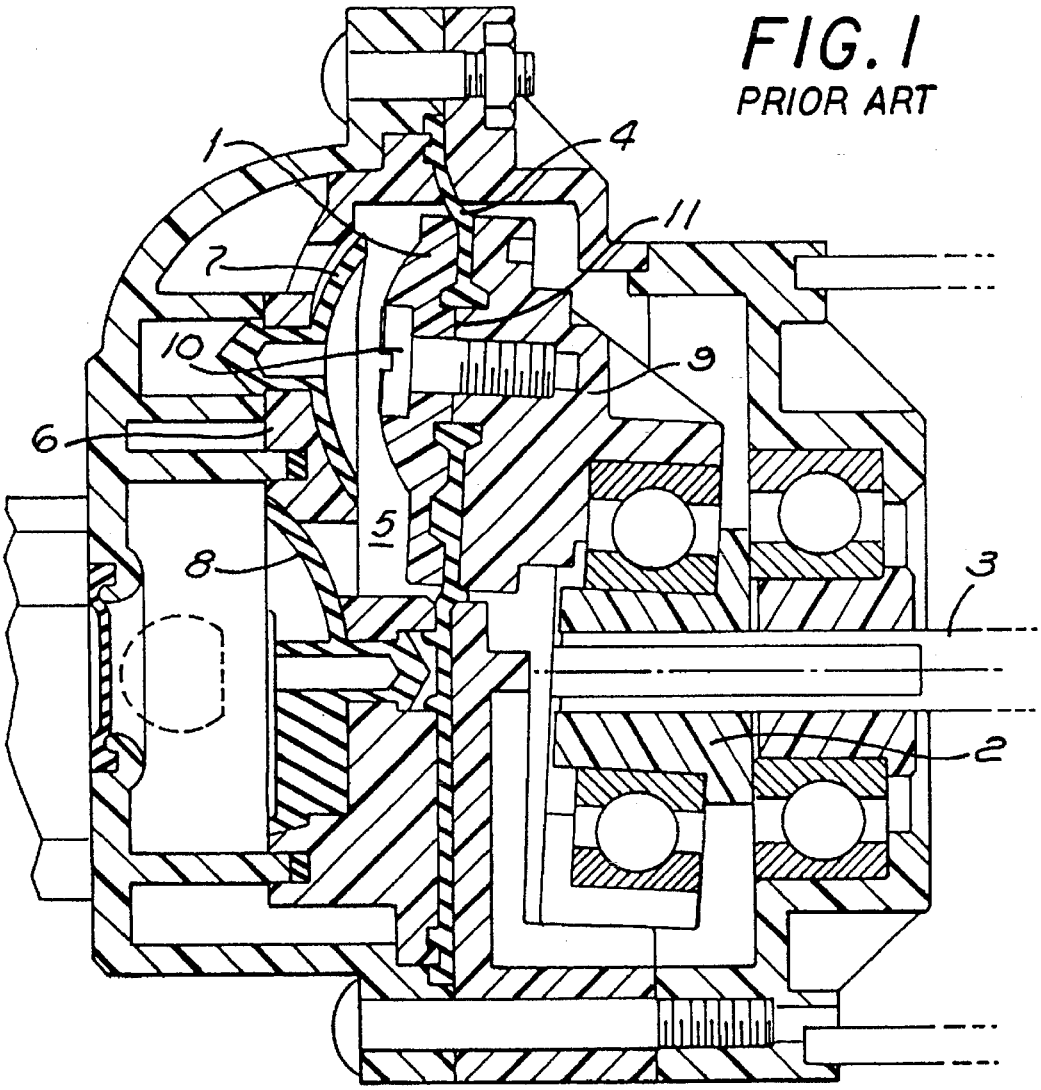
FIG. 1 PRIOR ART
FIG. 1 is a cross-sectional view of a wobble plate pump of the prior art.
Figure 2:
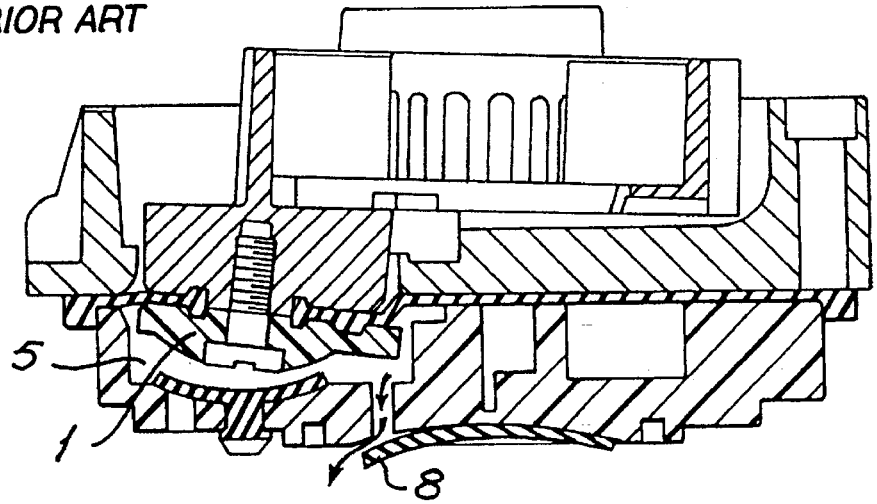
FIG. 2 PRIOR ART
FIG. 2 is a cross-sectional view of a pumping chamber of the prior art.
Figure 3:
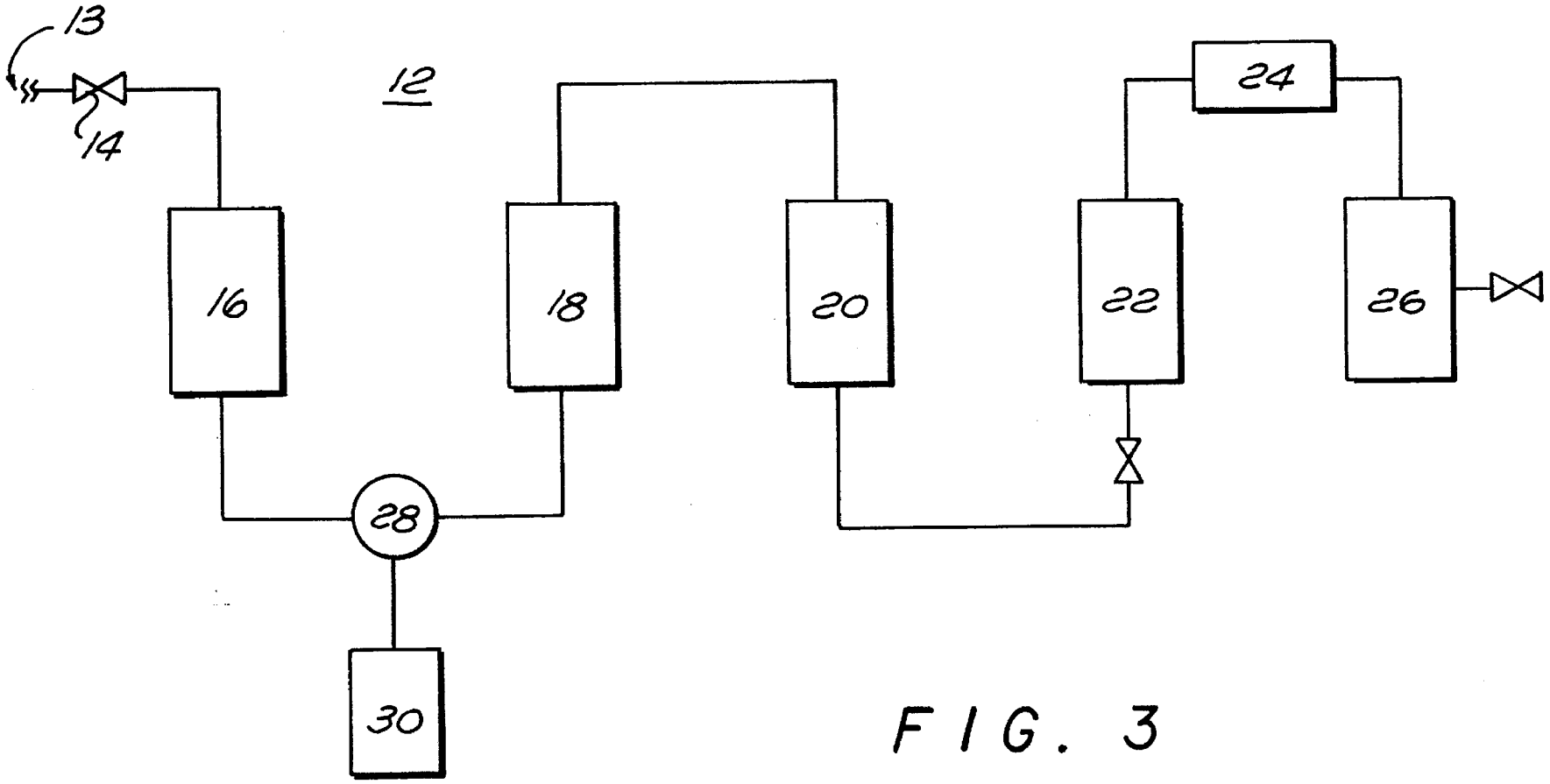
FIG. 3 is a schematic of a reverse osmosis water purification system of the present invention.

Referring to the drawings more particularly by reference numbers, FIG. 3 is a reverse osmosis water purification system 12. The system 12 purifies water that is provided by a source of water 13. The water source 13 is typically a municipal water supply. The flow of water into the system 12 can be controlled by an inlet valve 14. Attached to the inlet valve 14 is a sediment filter 16 which removes sediments from the water. Attached to the sediment filter 16 is a carbon filter 18 which absorbs dissolved gases in the water. The filtered water is provided to a reverse osmosis membrane 20 which removes impurities from the water. The water may be further processed by a post-carbon filter 22 and a ultraviolet (UV) filter 24 before being stored in a tank 26. The water is pumped through the system 12 by a pump 28 that is driven by a motor 30.

Figure 4:
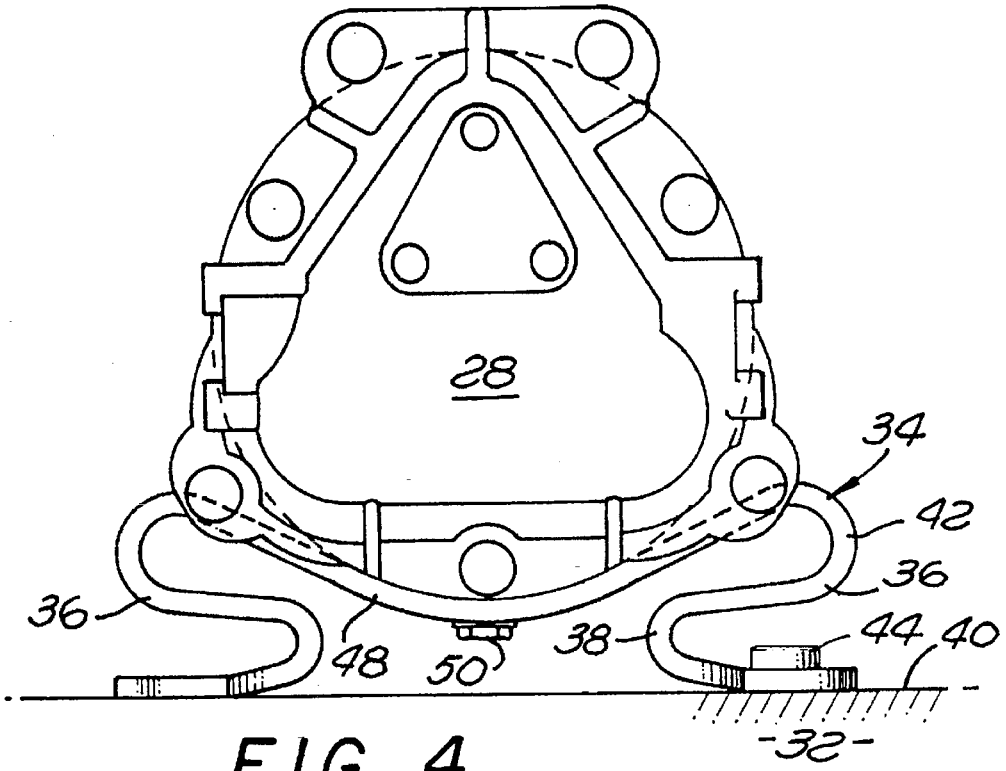
FIG. 4 is a front end view of a base plate for a pump/motor assembly.
Figure 5:
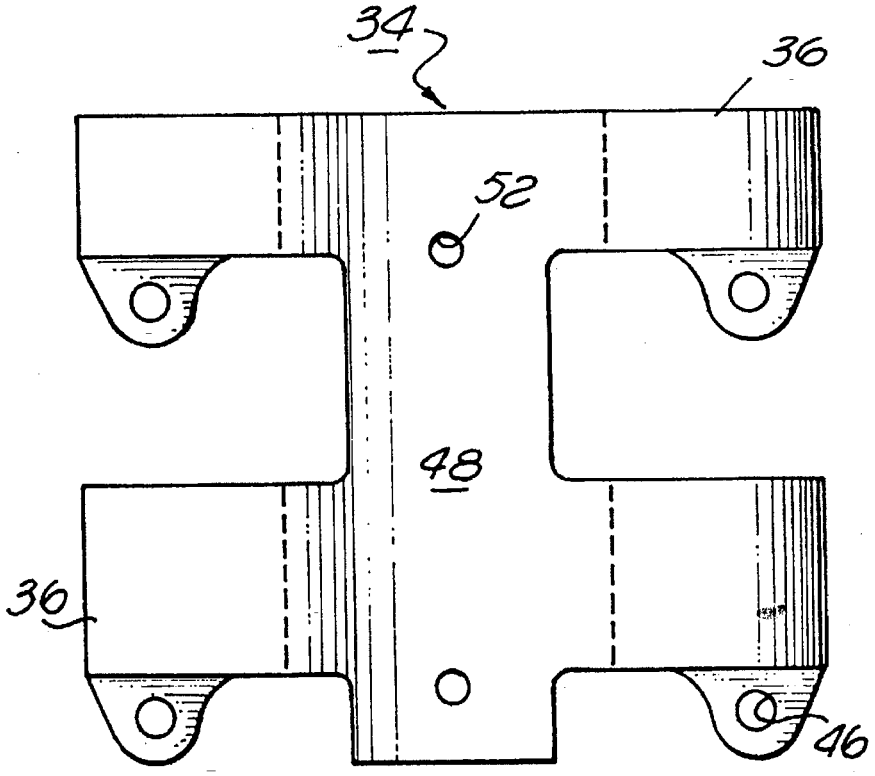
FIG. 5 is a top view of the base plate.

FIGS. 4 and 5 show a pump 28 and a motor (not shown) mounted to a mounting surface 32 by mounting bracket 34. The mounting bracket 34 has a plurality of legs 36 that are formed in a S-shape to provide a spring function. As a dynamic system the assembly can be modeled as a mass that is attached to a plurality of springs. The electrical power provided to the motor is typically 50–60 hertz (Hz). The power can create a harmonic frequency in the motor windings which can be modeled as a driving frequency for the mass/spring system. The harmonic frequency can resonant to create a sound that is transferred to the mounting surface.

To dampen the driving frequency and reduce the noise, the legs 36 are configured to have a spring rate which creates a mass/spring resonant frequency well outside the range of the driving frequency (e.g. 50–60 Hz). In the preferred embodiment, each leg 36 has a first bend 38 that is located approximately 0.3 inches from a bottom surface 40. The first bend 38 preferably has a radius of 0.125 inches. Each leg 36 may also have a second bend 42 located approximately 0.8 inches from the bottom surface 40. The second bend 42 preferably has a radius of 0.22 inches. The mounting bracket 34 can be attached to the mounting surface 32 by fasteners 44 that extend through clearance holes 46 in the legs 36. The pump 28 and motor 30 can be attached to a mounting area 48 of the base plate by fasteners 50 that extend through holes 52 in the shelf 48. The mounting area 48 preferably has a radius of 1.52 inches.

FIG. 6 shows a preferred embodiment of the pump 28. The pump 28 has a housing member 54 that is attached to a diaphragm support plate 56 by fasteners 58. The pump 28 is driven by an output shaft 60 of the motor 30. The output shaft 60 is coupled to the support plate 56 by a first bearing assembly 62. The output shaft 60 is also attached to a wobble plate 64. The wobble plate 64 is coupled to a rocker arm 66 by a second bearing assembly 68. The wobble plate 64 has a cam surface 70 which cooperates with the first bearing assembly 62 to move the rocker arm 66 in a reciprocating motion in response to a rotation of the output shaft 60.

The rocker arm 66 is attached to a diaphragm 72 and a piston 74. The diaphragm 72 is further captured by the housing member 54 and support plate 56. The piston 74 moves within a pump chamber 76 that is defined by a manifold plate 78. Attached to the manifold plate 78 is a one-way inlet valve 80 that controls the flow of water through inlet passage 82. The inlet passage 82 is in fluid communication with an inlet port (not shown) of the housing member 54. The pump also has a pair of one-way outlet valves 84 that control the flow of water through the outlet passage 86. The outlet passage 86 is in fluid communication with an outlet port 88 of the housing member 54. In the preferred embodiment, the pump has three pistons 74, three pump chambers 76 and three one-way valves 80 that are symmetrically located about the output shaft 60 and synchronously operated by the wobble plate 64 to continuously pump water through the pump.

In operation, the output shaft 60 rotates the wobble plate 64 which reciprocates the pistons 74. During an intake stroke, the volume of the pump chamber 76 increases and draws in water through the inlet valve 80. During the power stroke, the piston 74 pushes the water out of the pump chamber 76 and through the outlet valves 84. The cycle is repeated for each pump chamber as the output shaft 60 rotates the wobble plate 64.

FIG. 7 shows a top view of a diaphragm support plate 56 which has a plurality of openings 90. The openings 90 allow the pistons to be attached to the rocker arm. Each opening 90 has an inner lip with a first inner radius 92 located adjacent to the center of the diaphragm support plate 56 and a second inner radius 94 located at the perimeter of the support plate 56. The first radius 92 is smaller than the second radius 94. In the preferred embodiment, the first radius 92 is approximately 0.062 inches and the second radius 94 is 0.115 inches. The openings 90 typically have an inner radius that gradually varies from the first radius 92 to the second radius 94 about the circumference of each opening.

Figure 8:
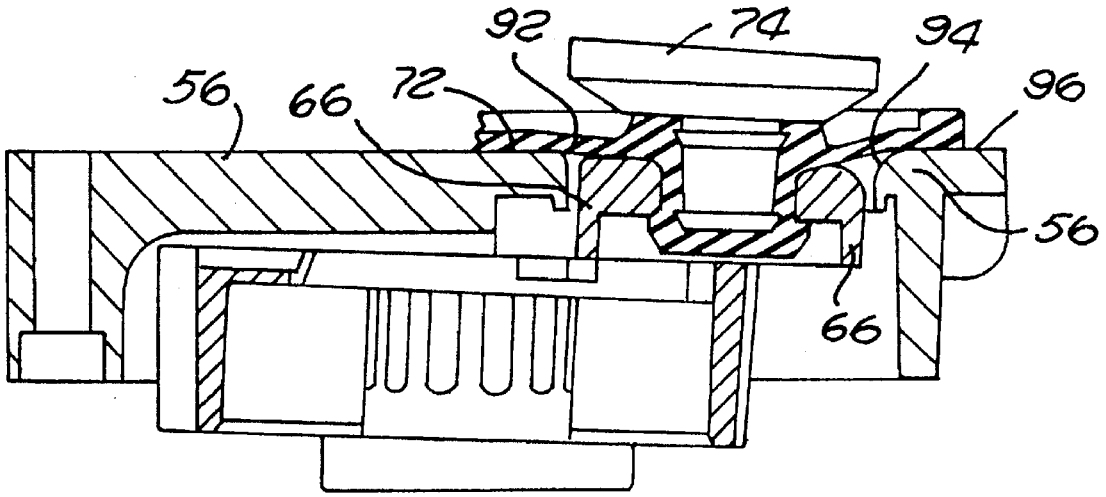
FIG. 8 is a cross-sectional view showing a piston assembly in a power stroke position.
Figure 9:
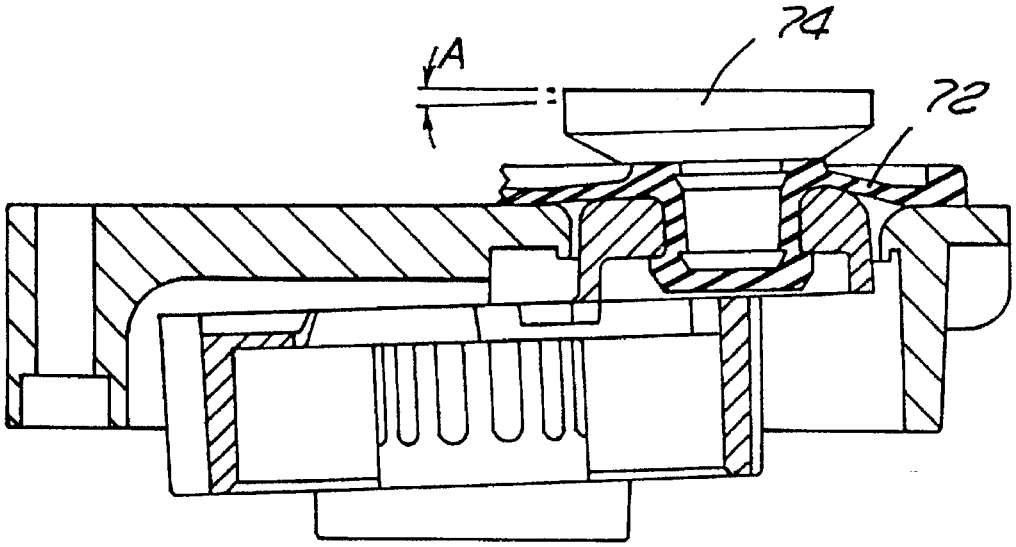
FIG. 9 is a cross-sectional view showing the piston assembly in an intake stroke position.

FIGS. 8 and 9 show the movement of a piston 74. When the piston 74 is in the intake stroke shown in FIG. 8, the diaphragm 72 is deflected to a position below surface 96 of the support plate 56. The radiuses of the opening 90 allow a full deflection of the diaphragm 72 without pinching the unsupported portion of the diaphragm between the rocker arm 66 and the support plate 56. Because the piston 74 is rotating about the centerline of the wobble plate 60, the outer portion of the diaphragm 72 moves a greater distance than the inner portion of the diaphragm. The second radius 94 is provided with a larger radius than the first radius 92 to allow the outer portion of the diaphragm to fully deflect on the intake stroke and reduce the stress on the diaphragm. The piston 74 has a symmetrical stroke about the surface 96 of the support plate 56, so that the diaphragm has an equal deflection during the intake stroke shown in FIG. 8, and the power stroke shown in FIG. 9. The symmetrical stroke assures equal and minimum stresses in the flexing portion of the diaphragm surface. In the preferred embodiment, the pumping surface of the piston 74 has an inclined angle A that compensates for the rocking motion of the rocker arm 66 so that at top dead center the piston 74 corresponds to the shape of the pump chamber 76. The angle A is typically selected to match the cam angle of the wobble plate 60. Therefore if the woddle plate 60 cam angle is 2°, the piston angle A is selected to be 2° so that the top surface of the piston 74 is parallel to the top of the pump chamber. This will assure a maximum compression ratio of the pump.

Figure 10:
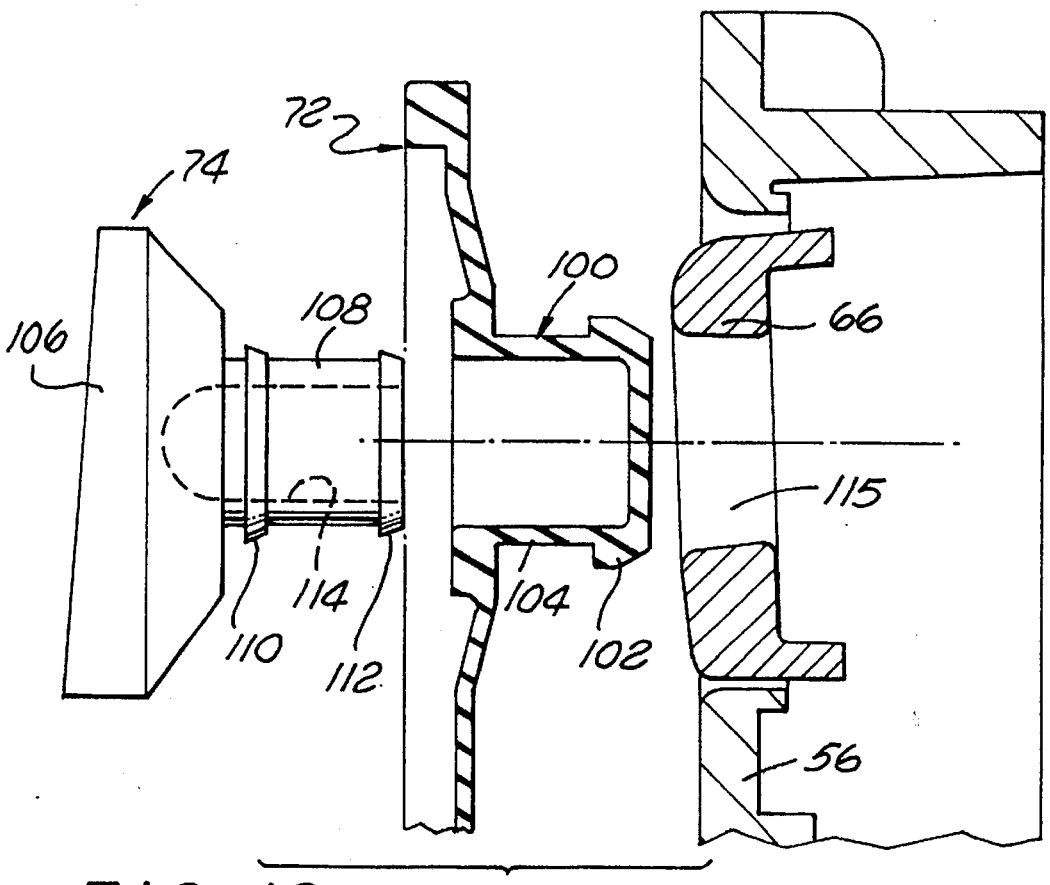
FIG. 10 is a cross-sectional view showing a piston before installation into a diaphragm.
Figure 11:
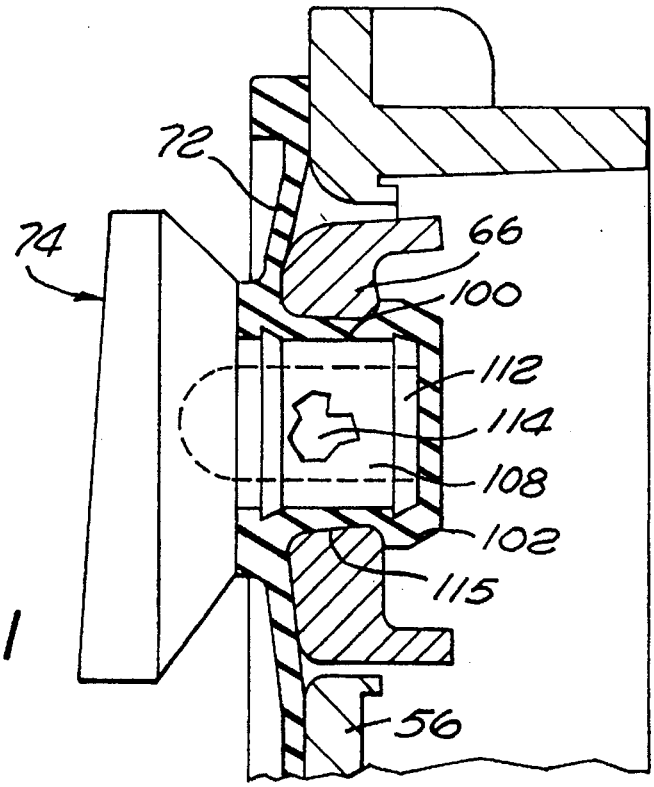
FIG. 11 is a cross-sectional view showing a piston after installation into the diaphragm.

FIGS. 10 and 11 show a preferred embodiment for attaching the pistons 74 to the diaphragm 72 to completely seal the wobble plate area of the pump. The diaphragm 72 has a sleeve 100 that includes a head portion 102 and a hollow neck portion 104. The piston 74 has a head portion 106 and a stem 108. The stem 108 has a pair of flanges 110 and 112, and an inner chamber 114 that has an opening in the end of the piston 74.

In the preferred embodiment, the stem 108 has an inward taper between flange 110 and flange 112 of approximately 5°. The tapered stem 108 allows the piston 74 to be inserted into the sleeve 100 while insuring a tight seal between the diaphragm 72 and the rocker arm 66. The piston 74 is typically constructed from a hard material that will not deflect during the pumping motion of the same. The dual flanges 110 and 112 capture the diaphragm 72 on both sides of the rocker arm 66 to prevent relative movement between the sleeve 100 and the arm 66. Capturing the sleeve 100 prevents wear on the diaphragm 72. The dual flanges also provide a companion back-up sealing arrangement, so that if one seal fails, the other seal is still in place and effective.

As shown in FIG. 11, the piston 74 is attached to the diaphragm 72 by pushing the stem 108 into the sleeve 100. The stem 108 and sleeve 100 extend through an opening 115 in the rocker arm 66. The stem 108 has a larger diameter than the inner diameter of the sleeve 100, so that the diaphragm 72 is expanded to seal the piston 74 to the rocker arm 66. The flange 112 expands the head portion 102 to lock the sleeve 100 onto the back side of the rocker arm 66. The inner chamber 114 provides a reservoir for the air within the sleeve 100, so that the air does not create a pneumatic back pressure that could push the piston 74 back out of the sleeve 100. The present invention provides a piston/diaphragm assembly that allows the piston 74 and diaphragm 72 to be readily assembled to a rocker arm 66 while maintaining a seal across the wobble plate area of the pump.

Figure 12:
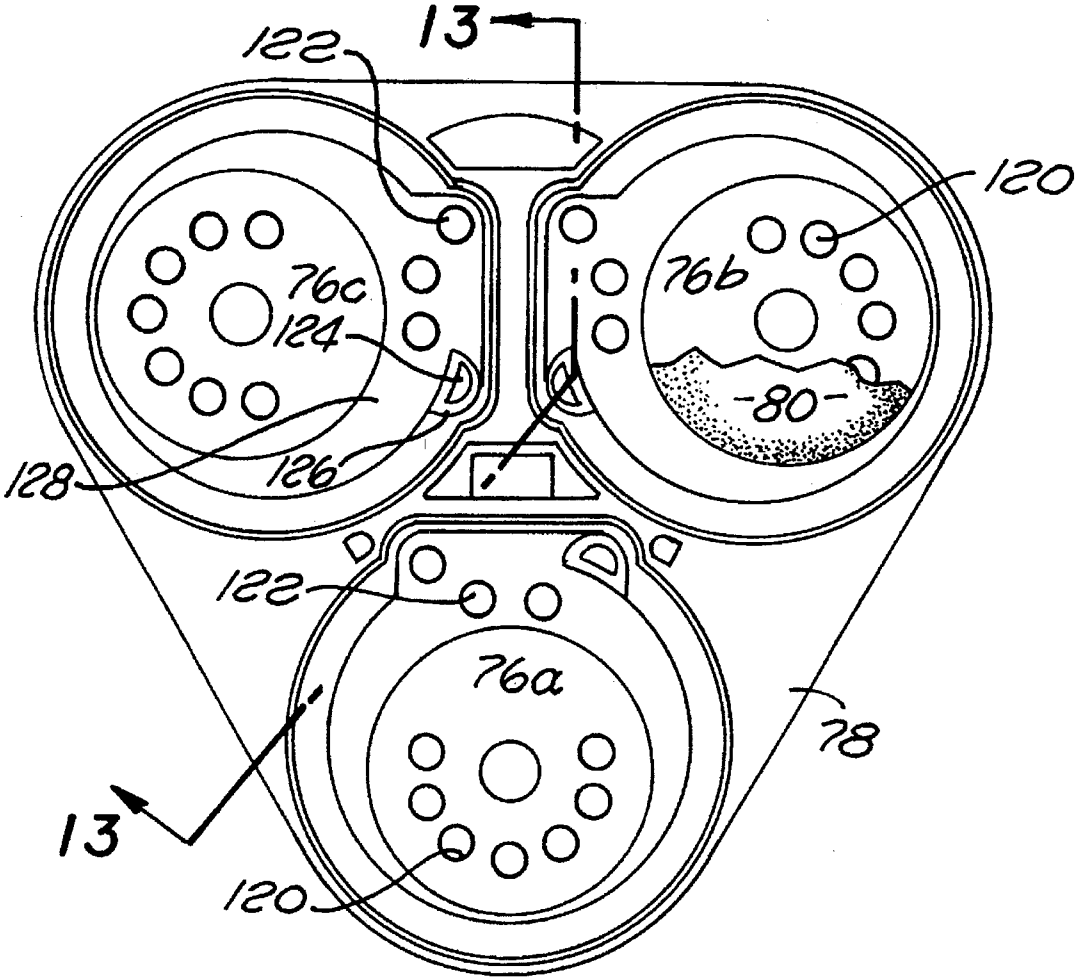
FIG. 12 is a top view of a manifold plate.

FIG. 12 shows a preferred embodiment of a manifold plate 78 which has a first pump chamber 76*a*, a second pump chamber 76*b* and a third pump chamber 76*c*. Each pump chamber contains a plurality of inlet passage openings 120. The openings 120 of each pump chamber 76 are normally covered by a corresponding one-way inlet valve 80. Each chamber 76 also has a plurality of outlet valve openings 122 and an air bleed passage 124. The air bleed passage 124 is defined by a passage wall 126 that extends from a base 128 of the manifold 78. The outlet openings 122 and bleed passages 120 are normally covered with the one-way outlet valves.

Figure 13:
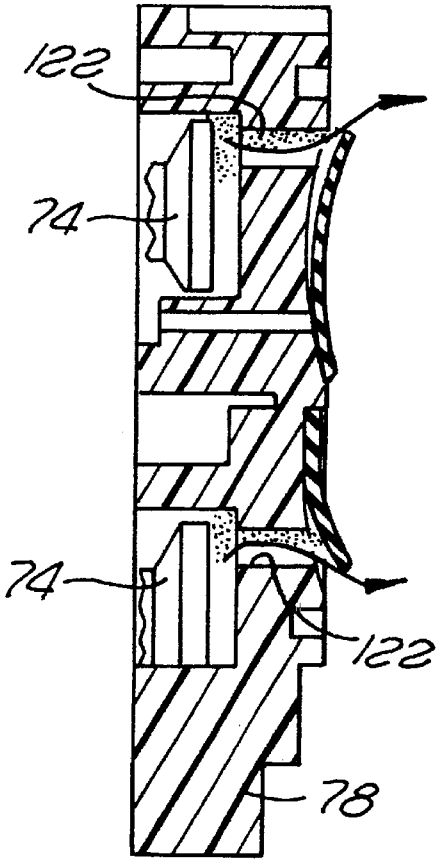
FIG. 13 is a side cross-sectional view showing air being bled out of a pump chamber in a pump that is horizontally mounted.

As shown in FIG. 13, when the pump is mounted in a horizontal position, any air that enters the pump chambers 76 will tend to accumulate at the top of the chambers. The outlet openings 122 are located at the top of the pump chambers, so that the air is pushed out of the chambers during each power stroke of the piston 74. Locating the openings in the top of each pump chamber prevents air from becoming entrapped within the chambers and cavitating the pump.

Figure 14:
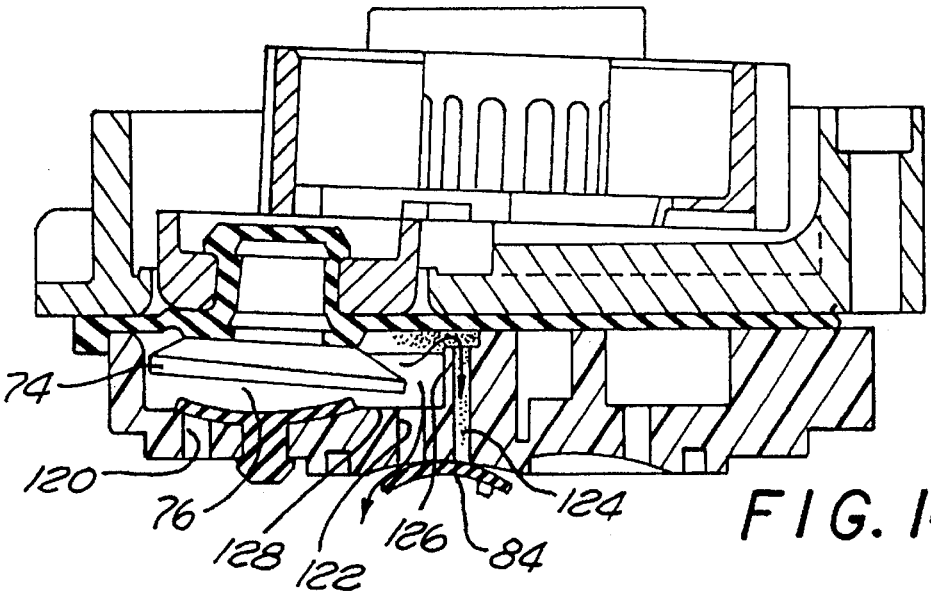
FIG. 14 is a side cross-sectional view showing air being bled out of a pump chamber in a pump that is vertically mounted.

As shown in FIG. 14, when the pump is mounted in a vertical position and the motor 30 is located above the pump 28, any air that enters the pump chamber 76 will tend to accumulate at the top of the chamber. The air bleed passage 124 provides a path for the air to be pushed out of the pump chamber 76 and through the outlet valve 84. The passage 124 allow the end user to vertically mount the pump 28, with the motor 30 above the pump 28, without inducing cavitation of the pump 28. It is desirable to maintain the motor 30 above the pump 28 so that any water leakage from the pump 28 will not flow into the motor 30.

Figure 15:
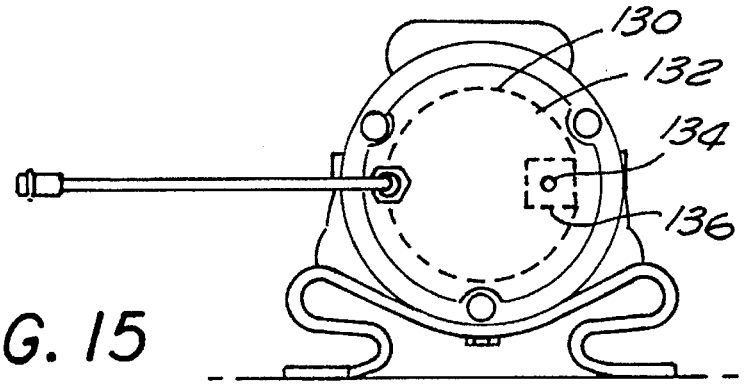
FIG. 15 is an end view of an electric motor which has a desiccant located in a breather port.
Figure 16:
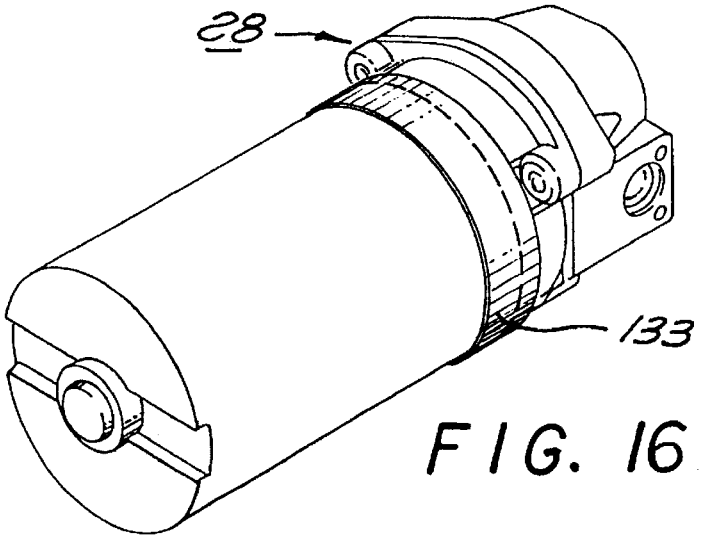
FIG. 16 is a side view showing a label wrapped around the pump and motor.

FIG. 15 shows a moisture removal system for an electric motor assembly. The assembly includes an electric motor 130 located within a housing 132. As shown in FIG. 16, the motor housing 132 is sealed by O-rings, gaskets (not shown) and a pump label 133 that wraps around the interface of the pump head and the motor 130. The housing 132 has except for a breather port 134 located at the end of the housing 132. Located within the housing 132 adjacent to breather port 134 is a desiccant 136. The motor 130 can become damaged when exposed to moisture from the atmosphere. The breather port 134 provides a flow path of relatively low fluid resistance, so that any air flow into and out of the housing 132 flows through the desiccant 136. The desiccant 136 removes any moisture within the air. The desiccant 136 can be periodically removed to maintain the life of the product.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A wobble plate pump, comprising:

a pump housing that has an inlet port and an outlet port;

a diaphragm support plate attached to said pump housing, said diaphragm support plate having an opening, said opening having an inner lip with both a first radius located adjacent to a center of said diaphragm support plate and a second radius located opposite from said first radius, wherein said second radius is larger than said first radius;

a manifold plate that contains a pump chamber;

a valve assembly that provides fluid communication between said pump chamber and said inlet and outlet ports;

a piston located within said pump chamber;

a rocker arm attached to said piston through said diaphragm support plate opening;

a diaphragm that is attached to said piston and said rocker arm, and covers said diaphragm support plate opening; and, a wobble plate coupled to said rocker arm.

2. The pump as recited in claim 1, wherein said inner lip has a varying radius from said first radius to said second radius.

3. A wobble plate pump, comprising:

a pump housing that has an inlet port and an outlet port;

a diaphragm support plate attached to said pump housing, said diaphragm support plate having an opening;

a manifold plate that contains a pump chamber;

a valve assembly that provides fluid communication between said pump chamber and said inlet and outlet ports;

a wobble plate;

a rocker arm that is coupled to said wobble plate, said rocker arm having an opening;

a diaphragm that covers said diaphragm support plate opening and which has a sleeve that extends through said rocker arm opening; and, a piston that is located within said pump chamber and which has a stem that is pressed into said diaphragm sleeve to attach said diaphragm and said piston to said rocker arm.

4. The pump as recited in claim 3, wherein said diaphragm sleeve has a head that locks onto a back surface of said rocker arm.

5. The pump as recited in claim 4, wherein said piston stem has a pair of flanges that are pressed into said diaphragm sleeve, one of said flanges being located on a front surface of said rocker arm and another flange being located on said back surface of said rocker arm.

6. The pump as recited in claim 3, wherein said piston stem has an inner chamber.

7. The pump as recited in claim 3, wherein said piston has an inclined pump surface.

8. The pump as recited in claim 3, wherein said diaphragm support plate opening has an inner lip with both a first radius and a second opposite radius.

9. The pump as recited in claim 8, wherein said second radius is larger than said first radius.

10. The pump as recited in claim 9, wherein said inner lip has a varying radius from said first radius to said second radius.

11. A method for mounting a piston and a diaphragm to a rocker arm of a wobble plate pump, comprising the steps of:

a) inserting a sleeve of a diaphragm through an opening of a rocker arm; and, b) pressing a stem of a piston into said diaphragm sleeve to attach said diaphragm and said piston to said rocker arm.

12. A wobble plate pump assembly, comprising:

a pump housing that has an inlet port and an outlet port;

a diaphragm support plate attached to said pump housing, said diaphragm support plate having an opening;

a manifold plate that contains three pump chambers, each said pump chamber having an inlet passage opening, and an outlet passage opening located in an upper portion of said pump chamber;

a valve assembly that provides fluid communication between said pump chamber and said inlet and outlet ports through said inlet and outlet passage openings;

a piston located within each pump chamber;

a rocker arm attached to each piston;

a wobble plate coupled to each rocker arm and to a horizontal drive shaft; and, a diaphragm that is attached to each piston and each rocker arm.

13. The pump as recited in claim 12, wherein said manifold plate has a passage wall that creates an air bleed passage which extends from said valve assembly to a location above said piston.

14. The pump as recited in claim 12, wherein said diaphragm has a sleeve that extends through a rocker arm opening and said piston has a stem that is pressed into said diaphragm sleeve to attach said diaphragm and said piston to said rocker arm.

15. The pump as recited in claim 14, wherein said diaphragm sleeve has a head that locks onto a back surface of said rocker arm.

16. The pump as recited in claim 15, wherein said piston stem has a pair of flanges that are pressed into said diaphragm sleeve, one of said flanges being located on a front surface of said rocker arm and another flange being located on said back surface of said rocker arm.

17. The pump as recited in claim 14, wherein said piston stem has an inner chamber.

18. The pump as recited in claim 14, wherein said piston has an inclined pump surface.

19. The pump as recited in claim 14, wherein said diaphragm support plate opening has an inner lip with both a first radius and a second opposite radius, one of said flanges being located on a front surface of said rocker arm and another flange being located on said back surface of said rocker arm.

20. The pump as recited in claim 19, wherein said second radius is larger than said first radius.

21. The pump as recited in claim 20, wherein said inner lip has a varying radius from said first radius to said second radius.

22. A wobble plate pump assembly, comprising:

a pump housing that has an inlet port and an outlet port;

a diaphragm support plate attached to said pump housing, said diaphragm support plate having an opening;

a manifold plate, mounted below said diaphragm support plate, that contains a pump chamber, said pump chamber having an inlet passage opening, an outlet passage opening, and an air bleed passage that has inlet opening in fluid communication with said pump chamber;

a valve assembly that provides fluid communication between said pump chamber and said inlet and outlet ports through said passage inlet and outlet openings, and said air bleed passage;

a piston within said pump chamber, said piston has a lower surface that is below said inlet opening of said air bleed passage;

a rocker arm attached to said piston;

a wobble plate coupled to said rocker arm and to vertical drive shaft; and, a diaphragm that is attached to said piston and said rocker arm.

23. The pump as recited in claim 22, wherein said diaphragm has a sleeve that extends through a rocker arm opening and said piston has a stem that is pressed into said diaphragm sleeve to attach said diaphragm and said piston to said rocker arm.

24. The pump as recited in claim 23, wherein said inlet passage opening is located in a lower portion of said pump chamber and said outlet passage opening is located in an upper portion of said pump chamber.

25. The pump as recited in claim 24, wherein said diaphragm support plate opening has an inner lip with both a first radius and a second opposite radius.

26. The pump as recited in claim 25, wherein said second radius is larger than said first radius.

27. The pump as recited in claim 26, wherein said inner lip has a varying radius from said first radius to said second radius.

28. The pump as recited in claim 27, wherein said diaphragm sleeve has a head that locks onto a back surface of said rocker arm.

29. The pump as recited in claim 28, wherein said piston stem has a pair of flanges that are pressed into said diaphragm sleeve, one of said flanges being located on a front surface of said rocker arm and another flange being located on said back surface of said rocker arm.

30. The pump as recited in claim 29, wherein said piston stem has an inner chamber.

31. The pump as recited in claim 30, wherein said piston has an inclined pump surface.

* * * * *